US010938155B2

(12) United States Patent
Lee et al.

(10) Patent No.: US 10,938,155 B2
(45) Date of Patent: Mar. 2, 2021

(54) REVERSIBLE CABLE ASSEMBLY CONNECTOR

(71) Applicant: 3M INNOVATIVE PROPERTIES COMPANY, St. Paul, MN (US)

(72) Inventors: Kok Hoe Lee, Geylang (SG); Saujit Bandhu, Sengkang (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/464,470

(22) PCT Filed: Dec. 18, 2017

(86) PCT No.: PCT/US2017/066924
§ 371 (c)(1),
(2) Date: May 28, 2019

(87) PCT Pub. No.: WO2018/118738
PCT Pub. Date: Jun. 28, 2018

(65) Prior Publication Data

US 2019/0379158 A1 Dec. 12, 2019

Related U.S. Application Data

(60) Provisional application No. 62/437,147, filed on Dec. 21, 2016.

(51) Int. Cl.
*H01R 13/627* (2006.01)
*H01R 12/62* (2011.01)
(Continued)

(52) U.S. Cl.
CPC ..... *H01R 13/6273* (2013.01); *H01R 12/62* (2013.01); *H01R 12/721* (2013.01); *H01R 13/516* (2013.01); *H01R 13/639* (2013.01)

(58) Field of Classification Search
CPC .. H01R 12/62; H01R 12/721; H01R 13/6273; H01R 13/639; H01R 13/516;
(Continued)

(56) References Cited

U.S. PATENT DOCUMENTS 4,526,431 A * 7/1985 Kasukawa ..... G02B 6/3877 439/153
5,161,990 A * 11/1992 Ling ..... H01R 27/00 439/173
(Continued)

FOREIGN PATENT DOCUMENTS

CN 203562539 U 4/2011
CN 202183518 U 4/2012
CN 201805112 U 4/2014

OTHER PUBLICATIONS

International Search Report for PCT International Application No. PCT/US2017/066924, dated Apr. 9, 2018, 3 pages.

*Primary Examiner* — Renee S Luebke
*Assistant Examiner* — Milagros Jeancharles
(74) *Attorney, Agent, or Firm* — Yufeng Dong

(57) ABSTRACT

Connectors or connector assemblies include first and second latching members attached to a housing thereof for latching the connector to a mating connector are provided. When the connector mates with the mating connector in a first/second mating orientation, the first/second latching member, but not the second/first latching member latches the connector to the mating connector.

15 Claims, 5 Drawing Sheets

(51) Int. Cl.
*H01R 12/72* (2011.01)
*H01R 13/516* (2006.01)
*H01R 13/639* (2006.01)

(58) Field of Classification Search
CPC ..... H01R 13/5841; H01R 13/6271; H01R 31/00; H01R 31/06; H01R 27/00; H01R 27/02
USPC ..... 439/352, 357, 723
See application file for complete search history.

(56) References Cited

U.S. PATENT DOCUMENTS 5,397,246 A * 3/1995 Defibaugh ..... H01R 13/627 439/352
5,411,402 A * 5/1995 Bethurum ..... G06K 19/07743 29/857
5,429,525 A * 7/1995 McCoy ..... H01R 13/627 439/352
5,993,230 A * 11/1999 Gauker ..... H01R 13/7032 200/51.1
6,357,930 B1 3/2002 Wiltjer
6,558,203 B2 * 5/2003 Pocrass ..... H01R 13/7175 439/218
6,568,965 B2 * 5/2003 Pocrass ..... H01R 13/7175 439/218
6,572,275 B2 6/2003 Shimoji
7,611,378 B1 * 11/2009 Brekosky ..... H01R 13/5202 439/500
7,731,519 B1 * 6/2010 Swenson, Jr. ..... H01R 13/502 439/352
8,177,585 B2 * 5/2012 Pocrass ..... H01R 24/60 439/676
9,490,549 B2 * 11/2016 Little ..... H01R 24/60
9,595,787 B2 * 3/2017 Qiao ..... H01R 12/7023
2002/0173191 A1 11/2002 I-Tse
2003/0013349 A1 * 1/2003 Pocrass ..... H01R 24/62 439/676
2004/0072473 A1 * 4/2004 Wu ..... H01R 31/06 439/638
2005/0037653 A1 * 2/2005 Comerci ..... H01R 23/661 439/329
2005/0233631 A1 10/2005 Wu
2011/0195595 A1 8/2011 Wu
2013/0231011 A1 * 9/2013 Sytsma ..... H01R 13/504 439/723
2014/0113487 A1 * 4/2014 Chen ..... H01R 24/62 439/607.01
2015/0044886 A1 * 2/2015 Little ..... H01R 13/6582 439/55
2015/0087175 A1 3/2015 Stowers
2015/0180169 A1 * 6/2015 Yu ..... H01R 13/112 439/357
2015/0318642 A1 * 11/2015 Lee ..... H01R 13/506 439/607.05
2015/0364865 A1 * 12/2015 Sutter ..... H01R 13/6273 439/345
2016/0056583 A1 2/2016 Chuang

* cited by examiner

REVERSIBLE CABLE ASSEMBLY CONNECTOR

CROSS REFERENCE TO RELATED APPLICATIONS

This application is a national stage filing under 35 U.S.C. 371 of PCT/US2017/066924, filed Dec. 18, 2017, which claims the benefit of U.S. Application No. 62/437,147, filed Dec. 21, 2016, the disclosure of which is incorporated by reference in its/their entirety herein.

FIELD

The disclosure relates to cable assembly connectors and, in particular, to connectors that includes first and second latching members for changing a mating orientation.

BACKGROUND

High-speed signal protocols such as, e.g., MiniSAS HD, etc. are widely used for various applications. For example, high-speed protocols are often used for data communication between various electronic apparatus such as storage devices in computers. Commercially available cable assembly connectors may be limited to standard basic designs. Users with specific geometrical requirements (e.g., due to space constraint, complex routing, etc.) that do not mechanically comply with the standard may be unable to find alternatives that fit their specifications.

SUMMARY

Briefly, in one aspect, the present disclosure describes a connector that includes an insulative housing, and a plurality of electrically conductive contacts disposed within the housing for engaging contacts of a mating connector. First and second latching members are integrally attached to the housing for latching the connector to the mating connector. The connector is configured to have different first and second mating orientations relative to the mating connector, such that when in the first mating orientation, the connector is configured to mate with the mating connector along a mating direction with the first latching member, but not the second latching member for latching the connector to the mating connector, and when in the second mating orientation, the connector is configured to mate with the mating connector along the mating direction with the second latching member, but not the first latching member for latching the connector to the mating connector, and such that for each of the first and second mating orientations, when the connector mates with the mating connector, the plurality of electrically conductive contacts engage corresponding contacts of the mating connector.

In another aspect, the present disclosure describes a connector assembly that includes a connector that includes an insulative housing, and a plurality of electrically conductive contacts disposed within the housing for engaging contacts of a mating connector. First and second latching members are integrally attached to the housing for latching the connector to the mating connector. The connector is configured to have different first and second mating orientations relative to the mating connector, such that when in the first mating orientation, the connector is configured to mate with the mating connector along a mating direction with the first latching member, but not the second latching member for latching the connector to the mating connector, and when in the second mating orientation, the connector is configured to mate with the mating connector along the mating direction with the second latching member, but not the first latching member for latching the connector to the mating connector, and such that for each of the first and second mating orientations, when the connector mates with the mating connector, the plurality of electrically conductive contacts engage corresponding contacts of the mating connector. A cable is partially received in the housing. The cable includes a plurality of wires, each wire making electrical connection to a corresponding contact in the plurality of electrically conductive contacts.

In yet another aspect, the present disclosure describes a connector including a plurality of latching members integral to the connector and a plurality of mating orientations with a one-to-one correspondence between the latching members and the mating orientations, such that for each mating orientation, the connector is configured to mate with a same mating connector along a same mating direction with only the latching member corresponding to the mating orientation latching onto the mating connector.

In yet another aspect, the present disclosure describes a connector including an insulative housing, and first and second spaced apart printed circuit boards at least partially disposed in the housing. Each circuit boards includes a plurality of electrically conductive contacts disposed on each major surface near a same mating end of the circuit boards. First and second latching members are integrally attached to opposing sides of the housing. The connector includes a first angular mating orientation relative to the mating direction in which the connector is configured to mate with the mating connector along the mating direction and only one of the first and second latching members latches the connector to the mating connector, and a different second angular mating orientation relative to the mating direction in which the connector is configured to mate with the mating connector along the mating direction and only the other one of the first and second latching members latches the connector to the mating connector, such that for each of the first and second angular mating orientations, when the connector mates with the mating connector, each plurality of electrically conductive contacts of each of the first and second circuit boards engages a plurality of contacts of the mating connector.

Various advantages are obtained in exemplary embodiments of the disclosure. One such advantage of exemplary embodiments of the present disclosure is that reversible latching features of a connector can increase efficiency in the routing of cables in constrained spaces. The latching features can be located on different sides of the connector, respectively providing latching mechanism under different mating orientations.

The details of one or more embodiments of the present disclosure are set forth in the accompanying drawings and the description below. Other features, objects, and advantages of the present disclosure will be apparent from the description and drawings, and from the claims.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1A:
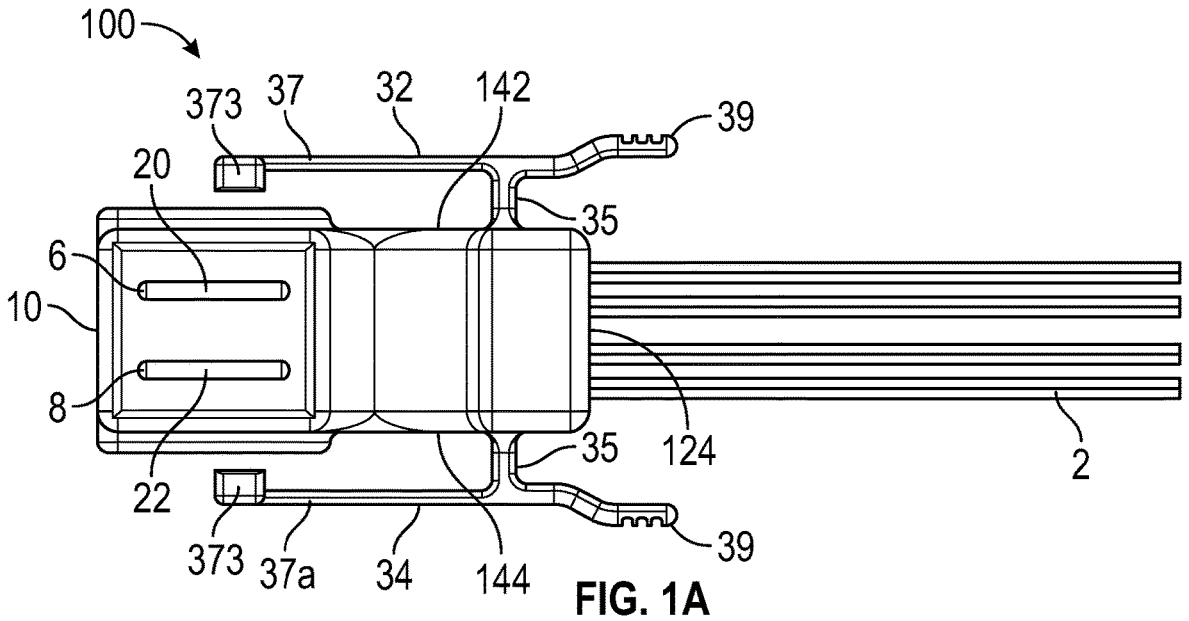
FIG. 1A is a front view of a connector assembly, according to one embodiment.

In the following detailed description, reference is made to the accompanying drawings that form a part hereof, and in which are shown by way of illustration several specific embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

Figure 1B:
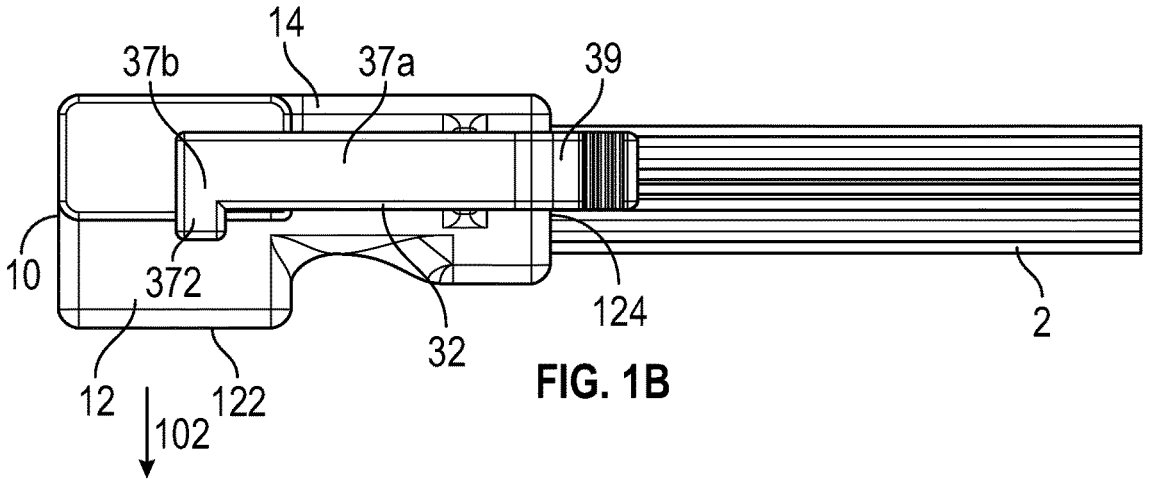
FIG. 1B is a top view of the connector assembly of FIG. 1A.
Figure 1C:
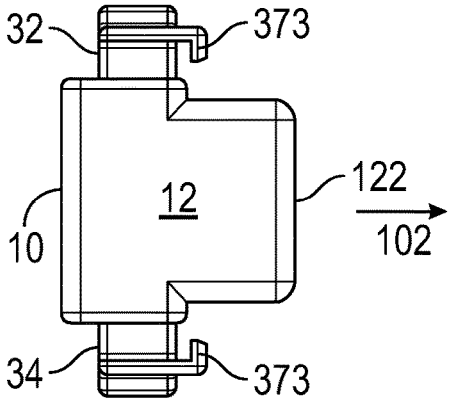
FIG. 1C is a side view of the connector assembly of FIG. 1A.

FIGS. 1A, 1B and 1C respectively illustrate a front, top and side perspective view of a connect 100, according to one embodiment. The connector 100 includes a housing 10 configured to insulate and securely position, or hold, one or more components of the connector 100 at least partially or entirely located within the housing 10. In some embodiments, one or more circuit boards can be received by and attached to the housing 10 via any suitable mechanisms. In the embodiment of FIG. 1A, circuit boards 6 and 8 are attached to the housing 10. The housing 10 may include electrically insulative, or dielectric, material, and thus, be referred to as an "insulative" housing. The insulative material of the housing 10 may include, for example, any suitable polymeric material.

Figure 5:
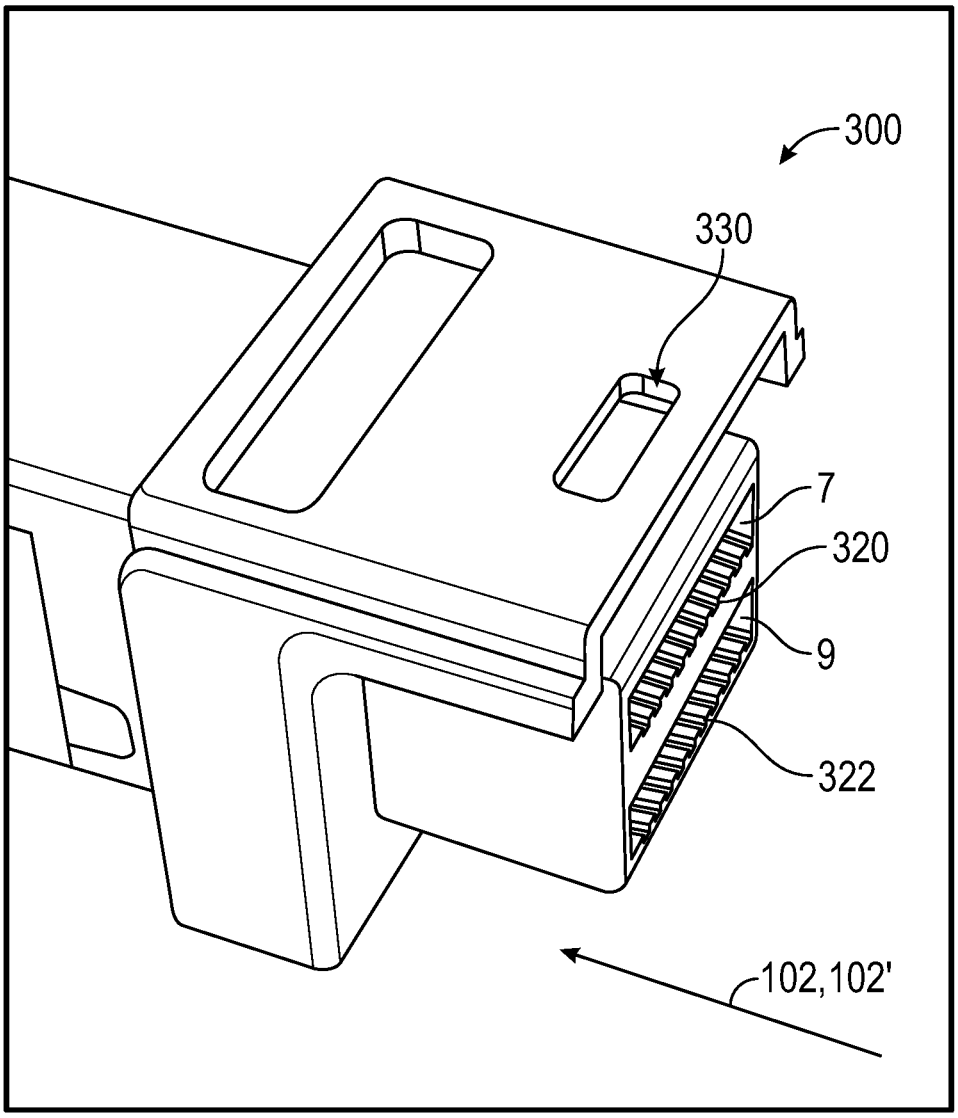
FIG. 5 is a side perspective view of a mating connector configured to mate with a connector in different orientations, according to one embodiment.

The housing 10 includes a mating end 122 for engaging a mating connector along a mating direction 102, and a cable end 124 for partially receiving wires or cables 2. An exemplary mating connector is illustrated in FIG. 5. The housing 10 has a "right-angled" configuration, i.e., the mating direction 102 and the extending direction of the cable 2 form an anger of about 90 degrees. In the depicted embodiment, the housing 10 is L-shaped including a shorter first section 12 substantially parallel to the mating direction 102 and terminating at the mating end 122 thereof, and a longer second section 14 substantially perpendicular to the mating direction 102 and terminating at the cable end 124 thereof.

The circuit boards 6 and 8 received by the housing 10 have electrically conductive contacts 20 and 22 disposed at the mating end 122. In some embodiments, at least one of the circuit boards 6 and 8 received by the housing 10 may have a shape following the shape of the housing 10 (e.g., an "L" shape). In some embodiments, at least one of the circuit board 6 and 8 may include first electrically conductive contacts (e.g., 20, 22) disposed adjacent the mating end 122, and second electrically conductive contacts disposed adjacent the cable end 124. At the cable end 124, the wires or cables 2 can make electrical connection to the respective second electrical contact of the circuit boards, which can be electrically connected to the first electrically conductive contacts 20 and 22 disposed at the mating end 122. In some embodiments, the wires or cables 2 may make a direction electrical connection to the electrically conductive contacts 20 and 22 disposed at the mating end 122.

The housing 10 further includes first and second latching members 32 and 34 integrally attached to opposite sides of the housing 10. The latching members 32 and 34 are configured to latch the connector 100 to a mating connector such as the mating connector 300 of FIG. 5. Each of the first and second latching members 32 and 34 includes a hinge portion 35 integrally attached to the housing 10. In the depicted embodiment of FIGS. 1A-1C, the first latching member 32 has its hinge portion 35 attached to a first side 142 of the longer second section 14. The second latching member 34 has its hinge portion 35 attached to a second, opposite side 144 of the longer second section 14. The geometries of latching members 32 and 34 on the opposite sides can be symmetrical or asymmetrical.

Each of the first and second latching members 32 and 34 further includes a resilient latch 37 attached to a side of the hinge portion 35, and a resilient actuation portion 39 attached to an opposite side of the hinge portion 35. In the depicted embodiment, the resilient actuation portion 39 is oriented substantially perpendicular to the mating direction 102. The resilient latch 37 is L-shaped including a longer first portion 37*a*, and a shorter second portion 37*b* connected to the longer first portion 37*a*. The longer first portion 37*a* is oriented substantially perpendicular to the mating direction 102. The shorter second portion 37*b* is oriented substantially along the mating direction 102 and terminating at a free end 372 of the resilient latch 37. The free end 372 is configured to latch onto a mating connector. Pressing down the resilient actuation portion 39 lifts the free end 372 away from the housing 10. The free end 372 includes a hook portion 373 for hooking on the mating connector.

The electrically conductive contacts 20 and 22 are disposed within the housing 10 for engaging respective contacts of a mating connector such as, for example contacts 320 and 322 of the mating connector 300 of FIG. 5. The first and second contacts 320 and 322 of the mating connector 300 are offset relative to each other along a direction perpendicular to the mating direction 102. The electrically conductive contacts 20 and 22 of the connector 100 can be disposed on a printed circuit board (PCB) which is at least partially disposed in the housing 10. The PCB can have a shape that follows the shape of the housing 10 (e.g., L-shaped). In some embodiments, the electrically conductive contacts 20 and 22 can be disposed on a major surface of the PCB near a mating end thereof. The contacts 320 and 322 of the mating connector 300 can be disposed on inside surfaces of slots 7 and 9 which are shaped to receive the respective circuit boards.

It is to be understood that one or more circuit boards can be attached to the housing 10. The circuit boards may be vertically spaced apart from one another. As used herein, "vertically spaced apart" may mean that the circuit boards may be separated by space in a thickness direction thereof. Additionally, each circuit boards may be arranged such that the planes thereof may be parallel to each other. It is to be understood that the circuit boards can be arranged in any suitable configurations.

Figure 2A:
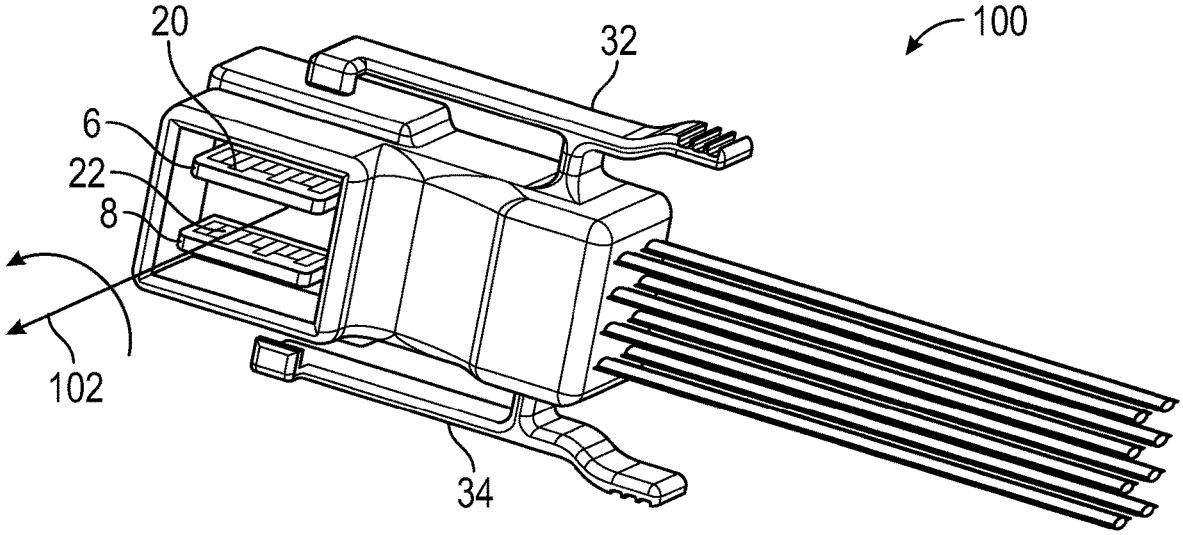
FIG. 2A is a perspective view of the connector assembly of FIG. 1A in a first mating orientation, according to one embodiment.
Figure 2B:
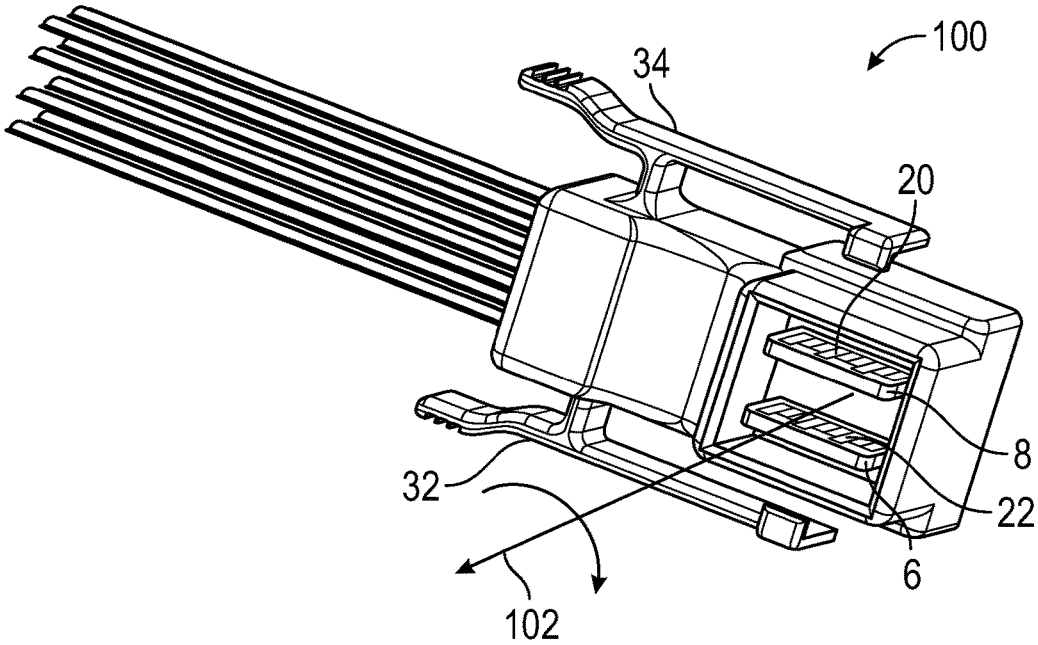
FIG. 2B is a perspective view of the connector assembly of FIG. 2A in a second mating orientation, according to one embodiment.

Referring now to FIGS. 2A-2B, the connector 100 is configured to have different first and second mating orientations relative to a mating connector. As shown in FIG. 2A, when the connector 100 is in the first mating orientation, the connector 100 is configured to mate with the mating connector along the mating direction 102 with the first latching member 32, but not the second latching member 34 latching the connector 100 to the mating connector. As shown in FIG. 2B, when the connector 100 is in the second mating orientation, the connector 100 is configured to mate with the mating connector along the mating direction 102 with the second latching member 34, but not the first latching member 32 latching the connector 100 to the mating connector.

For each of the first and second mating orientations, when the connector 100 mates with the mating connector (e.g., 300 in FIG. 5), the electrically conductive contacts (e.g., 20 and 22) can engage corresponding contacts of the mating connector such as, for example, contacts 320 and 322 of the mating connector 300. In the depicted embodiment, when the connector 100 mates with the mating connector 300 in the first mating orientation, the electrically conductive contacts 20 or 22 on the circuit boards 6 and 8 engage the contacts 320 or 322 in the slots 7 and 9 of the mating connector 300, respectively. When the connector 100 mates with the mating connector 300 in the second mating orientation, the electrically conductive contacts 20 or 22 the circuit boards 6 and 8 engage the contacts 320 or 322 in the slots 9 and 7 of the mating connector 300, respectively.

In some embodiments, one or more of the electrically conductive contacts (e.g., 20, 22, 320, and/or 322) may have a symmetrical contact design that allow electrical connection regardless of the change of mating orientations. For example, the electrical conductive contacts 20 can be provided on the upper surface of the upper circuit board 6 and on the bottom surface of the bottom circuit board 8; the electrical conductive contacts 22 can be provided on the upper surface of the bottom circuit board 8 and on the bottom surface of the upper circuit board 6 (see, e.g., FIG. 2A); the electrical conductive contacts 320 can be provided on the bottom surface of the upper slot 7 and on the upper surface of the bottom slot 9; the electrical conductive contacts 322 can be provided on the upper surface of the upper slot 7 and on the bottom surface of the bottom slot 9 (see, e.g., FIG. 5).

In the present disclosure, the first and second mating orientations can be respective first and second angular orientations relative to the mating direction 102. The angular difference between different mating orientations can be represented by a rotation anger of the connector around a rotation axis substantially parallel to the mating direction 102. In the depicted embodiment of FIGS. 2A and 2B, the first and second angular orientations differ by about 180 degrees.

When in the first mating orientation such as shown in FIG. 2A, the connector 100 mates with the mating connector 300 with the first latching member 32 contacting a first localized position 330 of the mating connector 300. When in the second mating orientation such as shown in FIG. 2B, the connector 100 mates with the mating connector 300 with the second latching member 34 contacting the first localized position 330 of the mating connector 300. The mating connector 300 includes a recess at the first localized position 330 for receiving the hook portion 373 of the connector 100. It is to be understood that any suitable latching mechanisms other than the hook-recess structure can be used for latching the connector 100 and the mating connector 300.

Figure 3A:
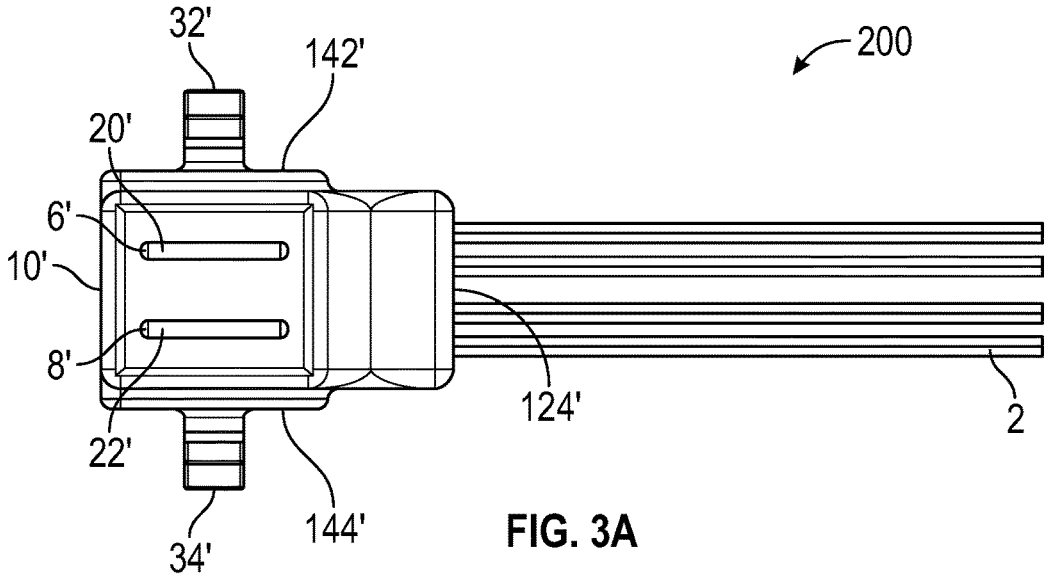
FIG. 3A is a front view of a connector assembly, according to one embodiment.
Figure 3B:
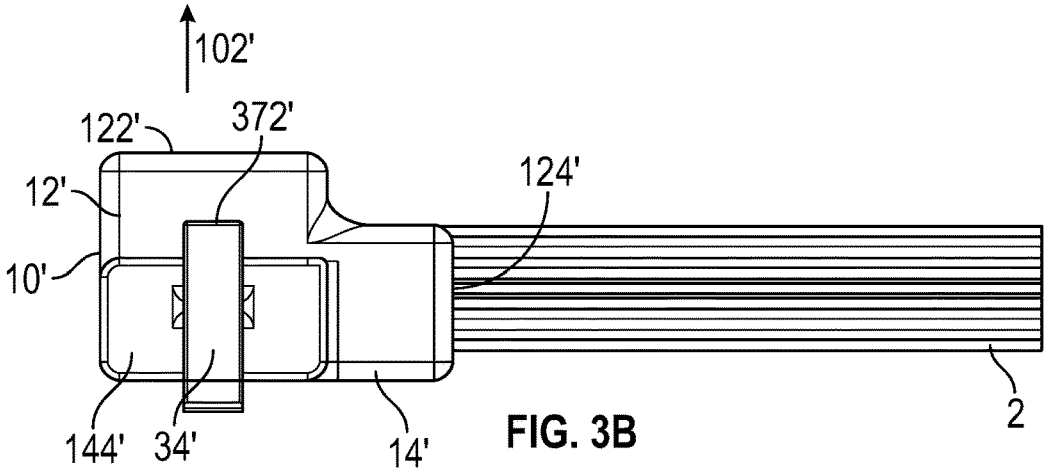
FIG. 3B is a top view of the connector assembly of FIG. 3A.
Figure 3C:
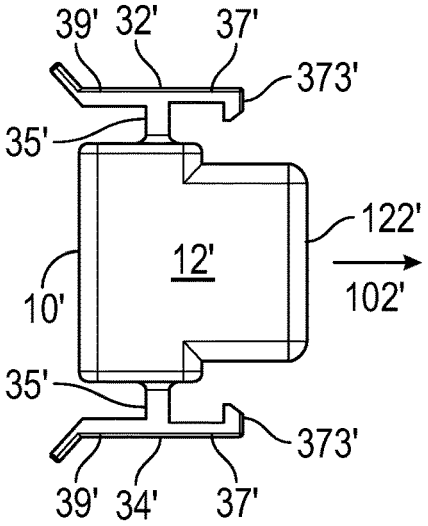
FIG. 3C is a side view of the connector assembly of FIG. 3A.

Referring now to FIGS. 3A, 3B and 3C, a front, top and side perspective views of a connect 200 are respectively shown, according to another embodiment. The connector 200 includes a housing 10' configured to insulate and securely position, or hold, one or more components (e.g., electrically conductive contacts or circuit boards) of the connector 200 at least partially or entirely located within the housing 200. The housing 10' may be made of the same materials as the housing 10.

The housing 10' includes a mating end 122' for engaging a mating connector (e.g., the mating connector in FIG. 5) along a mating direction 102', and a cable end 124' for receiving wires or cables 2. In the depicted embodiment, the housing 10' is L-shaped including a first section 12' substantially parallel to the mating direction 102' and terminating at the mating end 122' thereof, and a second section 14' substantially perpendicular to the mating direction 102' and terminating at the cable end 124' thereof.

Electrically conductive contacts 20' and 22' are received by the housing 10' and disposed at the mating end 122' thereof. The wires or cables 2 can enter the housing 10' from the cable end 124' and make electrical connection to the respective electrical contact 20' and 22'. Similar to the electrically conductive contacts 20 and 22, the electrically conductive contacts 20' and 22' can be disposed on circuit boards 6' and 8' which are attached to the housing 10'.

The housing 10' further includes first and second latching members 32' and 34' integrally attached to opposite sides of the housing 10'. The latching members 32' and 34' are configured to latch the connector 200 to a mating connector such as the mating connector 300 of FIG. 5. Each of the first and second latching members 32' and 34' includes a hinge portion 35' integrally attached to the housing 10'. In the depicted embodiment of FIGS. 3A-3C, the first latching member 32' has its hinge portion 35' attached to a first side 142' of the conjunction portion between the first and second sections 12' and 14'. The second latching member 34' has its hinge portion 35' attached to a second, opposite side 144' of the conjunction portion.

Each of the first and second latching members 32' and 34' further includes a resilient latch 37' attached to a side of the hinge portion 35', and a resilient actuation portion 39' attached to an opposite side of the hinge portion 35'. In the depicted embodiment, the resilient latch 37' and the resilient actuation portion 39' are oriented substantially parallel to the mating direction 102'. The resilient latch 37' extends to a free end 372' thereof. The free end 372' is configured to latch onto a mating connector. Pressing down the resilient actuation portion 39' lifts the free end 372' away from the housing 10'. The free end 372' includes a hook portion 373' for latching on the mating connector.

The electrically conductive contacts 20' and 22' are disposed within the housing 10' for engaging respective contacts of a mating connector such as, for example, the contacts 320 and 322 of the mating connector 300 of FIG. 5. The electrically conductive contacts 20' and 22' of the connector 200 can be disposed on a printed circuit board (PCB) which is at least partially disposed in the housing 10'. In the depicted embodiment of FIGS. 4A and 4B, the electrically conductive contacts 20' and 22' can be disposed on a major surface of the PCB near a mating end thereof. In some embodiments, the PCB can have a shape that follows the shape of the housing 10' (e.g., L-shaped).

Figure 4A:
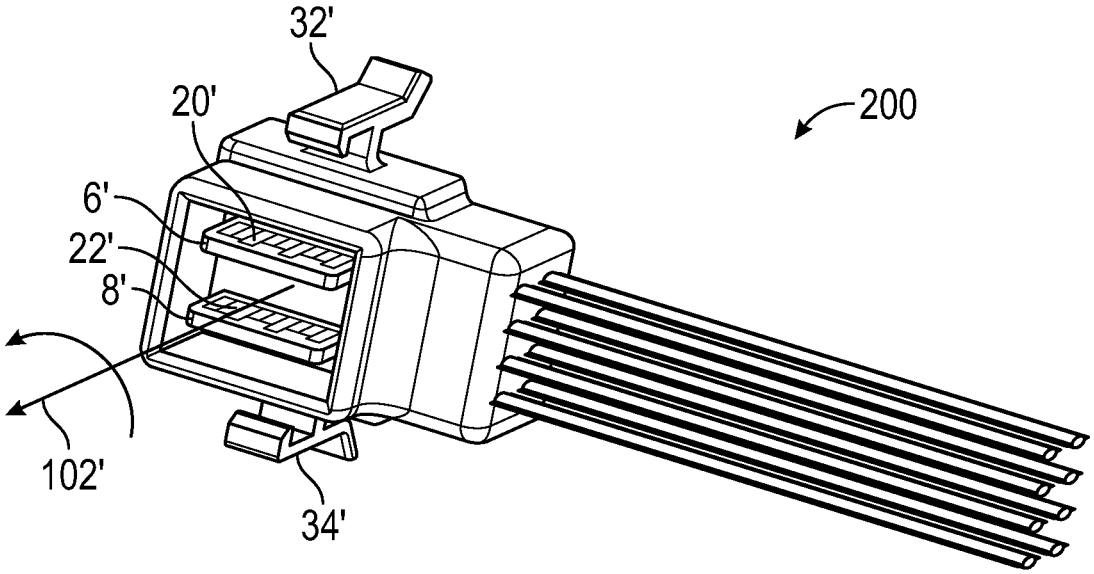
FIG. 4A is a perspective view of the connector assembly of FIG. 3A in a first mating orientation, according to one embodiment.
Figure 4B:
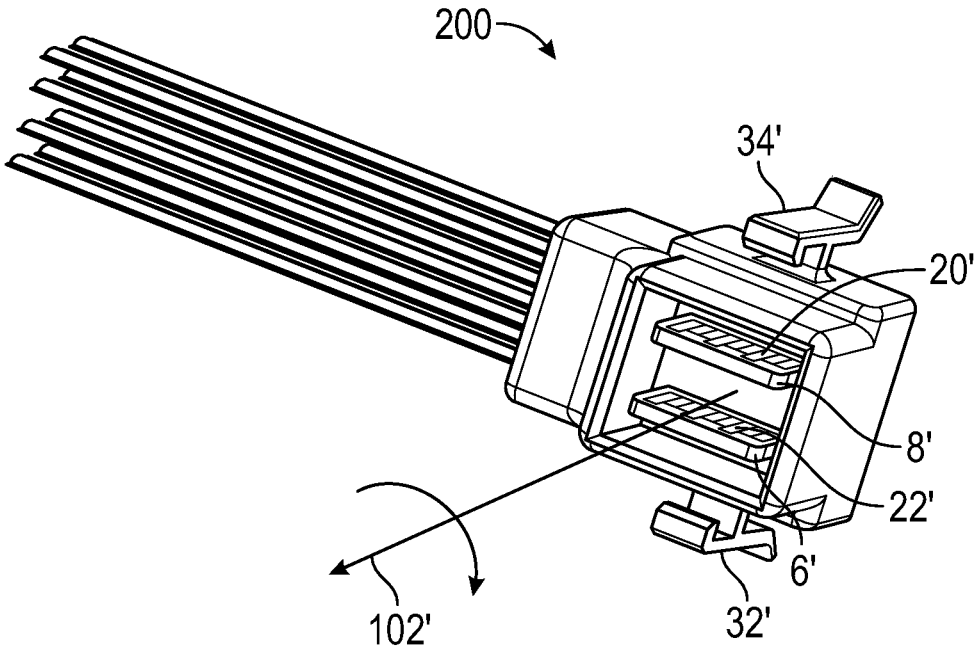
FIG. 4B is a perspective view of the connector assembly of FIG. 4A in a second mating orientation, according to one embodiment.

Referring now to FIGS. 4A-4B, the connector 200 is configured to have different first and second mating orientations relative to a mating connector. As shown in FIG. 4A, when the connector 200 is in the first mating orientation, the connector 200 is configured to mate with the mating connector along the mating direction 102' with the first latching member 32', but not the second latching member 34' latching the connector 200 to the mating connector. As shown in FIG. 4B, when the connector 200 is in the second mating orientation, the connector 200 is configured to mate with the mating connector along the mating direction 102' with the second latching member 34', but not the first latching member 32' latching the connector 200 to the mating connector.

In the depicted embodiment of FIGS. 4A and 4B, the first and second angular orientations differ by about 180 degrees. When in the first mating orientation such as shown in FIG. 4A, the connector 200 mates with the mating connector 300 with the first latching member 32' contacting a first localized position 330 of the mating connector 300. When in the second mating orientation such as shown in FIG. 4B, the connector 200 mates with the mating connector 300 with the second latching member 34' contacting the first localized position 330 of the mating connector 300.

For each of the first and second mating orientations, when the connector 200 mates with the mating connector, the electrically conductive contacts (e.g., 20' and 22') can engage corresponding contacts of the mating connector such as, for example, contacts 320 and 322 of the mating connector 300. In the depicted embodiment, when the connector 200 mates with the mating connector 300 in the first mating orientation, the electrically conductive contacts 20' or 22' on the circuit boards 6' and 8' engage the contacts 320 or 322 in the slots 9 and 7 of the mating connector 300, respectively. When the connector 100 mates with the mating connector 300 in the second mating orientation, the electrically conductive contacts 20' or 22' on the circuit boards 6' and 8' engage the contacts 320 or 322 in the slots 9 and 7 of the mating connector 300, respectively.

In some embodiments, first and second latching members are provided on different sides of the housing, which allow the connector to have reversible angular mating orientations relative to the mating direction in which the connector mates with the mating connector along the mating direction. Under one specific mating orientation, only one of the first and second latching members latches the connector to the mating connector. Reversibly changing to a different second angular mating orientation relative to the mating direction, the connector mates the mating connector with only the other one of the first and second latching members latches the connector to the mating connector.

In some embodiments, when the first and second latching members are provided on opposite sides of a connector housing, the first and second angular mating orientations may differ by 180 degrees (see, e.g., FIGS. 2A-2B and 4A-4B). In some embodiments, when the first and second latching members are provided on adjacent sides of a connector housing to locate 90 degrees apart, the first and second angular mating orientations may differ by 90 degrees. It is to be understood that the latching members can be provided on desired sides of a connector housing for desired angular mating orientations.

The present disclosure provides connectors or connector assemblies to mate with a mating connector along a mating direction under reversible mating orientations. The connectors described herein may have a "right-angled" configuration, which allows more efficient use of space for the routing of cables, and allows more versatile mating orientations, when coupled with the multiple latching members.

The connectors or connector assemblies described herein may be configured to be used in multiple different high-speed signal protocols such as, e.g., MiniSAS HD, etc. As shown, the connectors or connector assemblies may conform to SFF 8643, an integrated connector receptacle specification, developed by and available from the Small Form Factor (SFF) committee.

Listing of Exemplary Embodiments

The following are a list of embodiments of the present disclosure:

Embodiment 1 is connector comprising:

an insulative housing;

a plurality of electrically conductive contacts disposed within the housing for engaging contacts of a mating connector; and first and second latching members integrally attached to the housing for latching the connector to a mating connector, the connector configured to have different first and second mating orientations relative to a mating connector, such that when in the first mating orientation, the connector is configured to mate with the mating connector along a mating direction with the first, but not the second, latching member latching the connector to the mating connector, and when in the second mating orientation, the connector is configured to mate with the mating connector along the mating direction with the second, but not the first, latching member latching the connector to the mating connector, and such that for each of the first and second mating orientations, when the connector mates with the mating connector, the plurality of electrically conductive contacts engage corresponding contacts of the mating connector.

Embodiment 2 is the connector of embodiment 1, such that when the connector mates with the mating connector in the first mating orientation, the plurality of electrically conductive contacts engage a first plurality of contacts of the mating connector, and when the connector mates with the mating connector in the second mating orientation, the plurality of electrically conductive contacts engage a different second plurality of contacts of the mating connector.

Embodiment 3 is the connector of embodiment 1 or 2, wherein the first and second pluralities of contacts of the mating connector are offset relative to each other along a direction perpendicular to the mating direction.

Embodiment 4 is the connector of any one of embodiments 1-3, wherein the first and second mating orientations are respective first and second angular orientations relative to the mating direction.

Embodiment 5 is the connector of embodiment 4, wherein the first and second angular orientations differ by 90 degrees.

Embodiment 6 is the connector of embodiment 4, wherein the first and second angular orientations differ by 180 degrees.

Embodiment 7 is the connector of any one of embodiments 1-6 further comprising a printed circuit board (PCB) at least partially disposed in the housing, wherein the plurality of electrically conductive contacts are disposed on a major surface near a mating end of the PCB.

Embodiment 8 is the connector of any one of embodiments 1-7, wherein the housing is L-shaped comprising a shorter first section substantially parallel to the mating direction and terminating at a mating end of the connector, and a longer second section substantially perpendicular to the mating direction.

Embodiment 9 is the connector of any one of embodiments 1-8, wherein the housing comprises a mating end for engaging the mating connector and a cable end for receiving a plurality of wires, each wire making electrical connection to a corresponding contact in the plurality of electrically conductive contacts.

Embodiment 10 is the connector of any one of embodiments 1-9, wherein each of the first and second latching members comprises:

a hinge portion integrally attached to the housing;

a resilient latch attached to a side of the hinge portion and terminating at a free end for latching onto a mating connector; and a resilient actuation portion attached to an opposite side of the hinge portion, such that pressing down the actuation portion lifts the free end away from the housing.

Embodiment 11 is the connector of embodiment 10, wherein the free end comprises a hook portion for hooking on the mating connector.

Embodiment 12 is the connector of embodiment 10 or 11, wherein the resilient latch and the resilient actuation portion are oriented substantially along the mating direction.

Embodiment 13 is the connector of any one of embodiments 10-12, wherein the resilient actuation portion is oriented substantially perpendicular to the mating direction, and the resilient latch is L-shaped comprising a longer first portion oriented substantially perpendicular to the mating direction and a shorter second portion oriented substantially along the mating direction and terminating at the free end of the resilient latch.

Embodiment 14 is the connector of any one of embodiments 1-13, such that when in the first mating orientation, the connector mates with the mating connector with the first latching member contacting a first localized position of the mating connector, and when in the second mating orientation, the connector mates with the mating connector with the second latching member contacting the first localized position of the mating connector.

Embodiment 15 is the connector of embodiment 14, wherein the mating connector comprises a recess at the first localized position for receiving the resilient latch of the connector.

Embodiment 16 is a connector assembly comprising:

the connector of any one of embodiments 1-15; and a cable partially received in the housing and comprising a plurality of wires, each wire making electrical connection to a corresponding contact in the plurality of electrically conductive contacts.

Embodiment 17 is a connector assembly comprising the connector of embodiment 16 mated with a mating connector, such that only one of the first and second latching members latches onto the mating connector.

Embodiment 18 is the connector assembly of embodiment 17, wherein only one of the first and second latching members contacts the mating connector.

Embodiment 19 is the connector of any one of embodiments 1-15, wherein the first and second latching members are substantially identical.

Embodiment 20 is the connector of any one of embodiments 1-15, wherein the first and second latching members are mirror images of each other.

Embodiment 21 is a connector comprising a plurality of latching members integral to the connector and a plurality of mating orientations with a one-to-one correspondence between the latching members and the mating orientations, such that for each mating orientation, the connector is configured to mate with a same mating connector along a same mating direction with only the latching member corresponding to the mating orientation latching onto the mating connector.

Embodiment 22 is the connector of embodiment 21, wherein each mating orientation is a different angular orientation relative to the mating direction.

Embodiment 23 is a connector assembly configured to mate with a mating connector along a mating direction and comprising:

an insulative housing;

first and second spaced apart printed circuit boards (PCBs) at least partially disposed in the housing, each PCB comprising a plurality of electrically conductive contacts disposed on each major surface near a same mating end of the PCB; and first and second latching members integrally attached to opposing sides of the housing, the connector comprising a first angular mating orientation relative to the mating direction in which the connector is configured to mate with the mating connector along the mating direction and only one of the first and second latching members latches the connector to the mating connector, and a different second angular mating orientation relative to the mating direction in which the connector is configured to mate with the mating connector along the mating direction and only the other one of the first and second latching members latches the connector to the mating connector, such that for each of the first and second angular mating orientations, when the connector mates with the mating connector, each plurality of electrically conductive contacts of each of the first and second PCBs engages a plurality of contacts of the mating connector.

Embodiment 24 is the connector of embodiment 22, wherein the first and second angular mating orientations differ by about 180 degrees.

Thus, embodiments of REVERSIBLE CABLE ASSEMBLY CONNECTOR are disclosed. One skilled in the art will appreciate that the compositions described herein can be practiced with embodiments other than those disclosed. The disclosed embodiments are presented for purposes of illustration and not limitation.

What is claimed is:

1. A connector comprising:

an insulative housing;

a plurality of electrically conductive contacts disposed within the housing for engaging contacts of a mating connector; and first and second latching members integrally attached to the housing for latching the connector to the mating connector, the connector configured to have different first and second mating orientations relative to the mating connector, such that when in the first mating orientation, the connector is configured to mate with the mating connector along a mating direction with the first latching member, but not the second latching member latching the connector to the mating connector, and when in the second mating orientation, the connector is configured to mate with the mating connector along the mating direction with the second latching member, but not the first latching member latching the connector to the mating connector, and such that for each of the first and second mating orientations, when the connector mates with the mating connector, the plurality of electrically conductive contacts engage corresponding contacts of the mating connector, wherein the first and second mating orientations are respective first and second angular orientations relative to the mating direction, and wherein the first and second angular orientations differ by 90 degrees.

2. The connector of claim 1, such that when the connector mates with the mating connector in the first mating orientation, the plurality of electrically conductive contacts engage a first plurality of contacts of the mating connector, and when the connector mates with the mating connector in the second mating orientation, the plurality of electrically conductive contacts engage a different second plurality of contacts of the mating connector.

3. The connector of claim 2, wherein the first and second pluralities of contacts of the mating connector are offset relative to each other along a direction perpendicular to the mating direction.

4. The connector of claim 1 further comprising a printed circuit board (PCB) at least partially disposed in the housing, wherein the plurality of electrically conductive contacts are disposed on a major surface near a mating end of the PCB.

5. The connector of claim 1, wherein the housing is L-shaped comprising a shorter first section substantially parallel to the mating direction and terminating at a mating end of the connector, and a longer second section substantially perpendicular to the mating direction.

6. The connector of claim 1, wherein the housing comprises a mating end for engaging the mating connector and a cable end for receiving a plurality of wires, each wire making electrical connection to a corresponding contact in the plurality of electrically conductive contacts.

7. The connector of claim 1, wherein each of the first and second latching members comprises:

a hinge portion integrally attached to the housing;

a resilient latch attached to a side of the hinge portion and terminating at a free end for latching onto the mating connector; and a resilient actuation portion attached to an opposite side of the hinge portion, such that pressing down the actuation portion lifts the free end away from the housing.

8. The connector of claim 7, wherein the resilient latch and the resilient actuation portion are oriented substantially along the mating direction.

9. The connector of claim 7, wherein the resilient actuation portion is oriented substantially perpendicular to the mating direction, and the resilient latch is L-shaped comprising a longer first portion oriented substantially perpendicular to the mating direction and a shorter second portion oriented substantially along the mating direction and terminating at the free end of the resilient latch.

10. The connector of claim 1, such that when in the first mating orientation, the connector mates with the mating connector with the first latching member contacting a first localized position of the mating connector, and when in the second mating orientation, the connector mates with the mating connector with the second latching member contacting the first localized position of the mating connector.

11. The connector of claim 10, wherein the mating connector comprises a recess at the first localized position for receiving the resilient latch of the connector.

12. A connector assembly comprising:

the connector of claim 1; and a cable partially received in the housing and comprising a plurality of wires, each wire making electrical connection to a corresponding contact in the plurality of electrically conductive contacts.

13. A connector assembly comprising the connector of claim 1 mated with a mating connector, such that only one of the first and second latching members latches onto the mating connector.

14. A connector assembly configured to mate with a mating connector along a mating direction and comprising:

an insulative housing;

first and second spaced apart circuit boards at least partially disposed in the housing, each circuit boards comprising a plurality of electrically conductive contacts disposed on each major surface near a same mating end of the circuit boards; and first and second latching members integrally attached to opposing sides of the housing, the connector comprising a first angular mating orientation relative to the mating direction in which the connector is configured to mate with the mating connector along the mating direction and only one of the first and second latching members latches the connector to the mating connector, and a different second angular mating orientation relative to the mating direction in which the connector is configured to mate with the mating connector along the mating direction and only the other one of the first and second latching members latches the connector to the mating connector, such that for each of the first and second angular mating orientations, when the connector mates with the mating connector, each plurality of electrically conductive contacts of each of the first and second circuit boards engages a plurality of contacts of the mating connector.

15. The connector of claim 14, wherein the first and second angular mating orientations differ by about 180 degrees.

* * * * *